United States Patent [19]

Batteux et al.

[11] 4,219,790

[45] Aug. 26, 1980

[54] CURRENT LIMITING CIRCUIT BREAKER

[75] Inventors: Pierre Batteux, Vizille; Robert Morel, Eybens, both of France

[73] Assignee: Merlin Gerin, Grenoble, France

[21] Appl. No.: 17,557

[22] Filed: Mar. 5, 1979

[30] Foreign Application Priority Data

Mar. 31, 1978 [FR] France ..... 78 09833

[51] Int. Cl.[3] ..... H01H 77/10

[52] U.S. Cl. ..... 335/16; 335/195

[58] Field of Search ..... 335/16, 147, 195, 18

[56] References Cited

U.S. PATENT DOCUMENTS

| | | | |
|---|---|---|---|
| 3,263,042 | 7/1966 | Dyer et al. | 335/16 |
| 3,815,059 | 6/1974 | Spoelman | 335/16 |
| 3,824,508 | 7/1974 | Terracol | 335/16 |
| 4,056,798 | 11/1977 | Malick | 335/16 |

FOREIGN PATENT DOCUMENTS

| | | |
|---|---|---|
| 827821 | 1/1952 | Fed. Rep. of Germany . |
| 2246052 | 9/1974 | France . |

*Primary Examiner*—Harold Broome

*Attorney, Agent, or Firm*—Stevens, Davis, Miller & Mosher

[57] ABSTRACT

A circuit breaker having a magnetic device energized by the current flowing through the circuit breaker to drive a contact arm to an open position at high speed to provide current limiting upon occurrence of a predetermined overcurrent condition. The magnetic device comprises a saturable magnetic shunt path, the iron of which saturates above said predetermined overcurrent condition, to energize the magnetic device and to cause a straightforward opening of the contacts.

7 Claims, 4 Drawing Figures

CURRENT LIMITING CIRCUIT BREAKER

This invention relates to a current limiting circuit breaker having high-speed opening means which are energized by the current flowing through the circuit breaker. A circuit breaker of this type is disclosed in the U.S. Pat. No. 3,815,059 and comprises a plurality of plates of magnetic material with a slot at one end. The contact arm is disposed in this slot and the electromagnetic forces generated by the current flowing in the contact arm urge the contact arm upwards in the slot to thereby drive the contact arm to an open position at high speed to provide current limiting. The electromagnetic forces act against the spring force maintaining the movable contact in engagement with the fixed contact. The utilization of this known device, particularly in high-current circuit breakers or interrupters having for instance a current rating of 500 A and more, causes erratic movements of the contacts and untimely wear and welding of the contacts.

In accordance with this invention, it has been found that the foregoing disadvantages may be overcome by providing a saturable flux flow shunt path for the magnetic device actuating the contact arm. A normal current flowing in the contact arm generates a magnetic flux mainly flowing in the shunt path. The magnetic flux in the contact arm area will be negligible and the contact engagement pressure produced by the spring is not reduced by electromagnetic forces produced by the magnetic device. The iron of the shunt path saturates before the iron of the main path of the magnetic device and this saturation occurs when the value of the current flowing through the contact arm is higher than a threshold value. In that case the magnetic flux in the main path increases and the magnetic device becomes active. The threshold value at which the magnetic device develops electromagnetic forces to move the movable contact rapidly towards the open circuit position thereof corresponds to the threshold value of the conventional electromagnetic tripping device of the circuit breaker thereby causing a straightforward and definitive opening of the contacts.

The magnetic device comprises a yoke having two lateral pole pieces surrounding the contact arm in the closed position. The shunt path comprises two legs protruding from said pole pieces and having a smaller iron section than these pole pieces so as to saturate first.

Other objects and advantages will become apparent from the following description of an embodiment of the invention when read in conjunction with the accompanying drawings in which.

Figure 1:
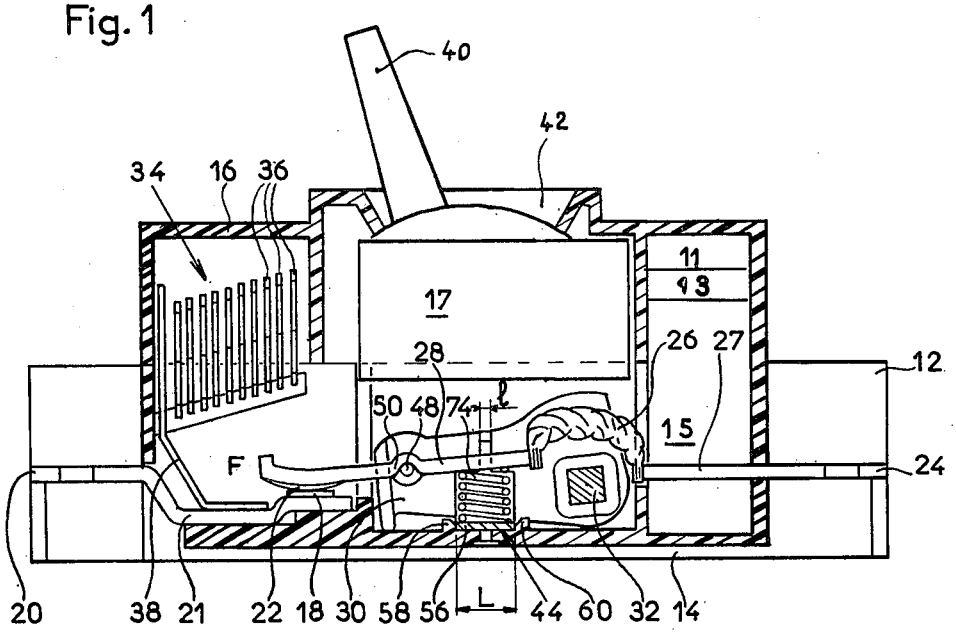
FIG. 1 is a longitudinal sectional view of one pole of the current limiting circuit breaker constructed in accordance with the invention and shown in the ON position.

With reference to the drawings, a circuit breaker has a molded case 12 comprising a base 14 and a cover 16 and containing a trip unit 15 and an operating toggle mechanism 17 common to the various poles for instance to the three poles of the circuit breaker. Electrically connected to a terminal 20 by a conductor 21 is a fixed contact 18 which cooperates with a movable contact 22 mounted upon a contact arm 28. The contact arm 28 is electrically connected to a terminal 24 by a woven shunt 26 and a conductor 27. An arc extinguishing structure 34 with plates 36 is disposed in proximity to the contacts 18, 22 in such a manner that an arc formed between contacts 18, 22 is rapidly driven along an arcing rail 38 towards the arc extinguishing structure 34.

Figure 4:
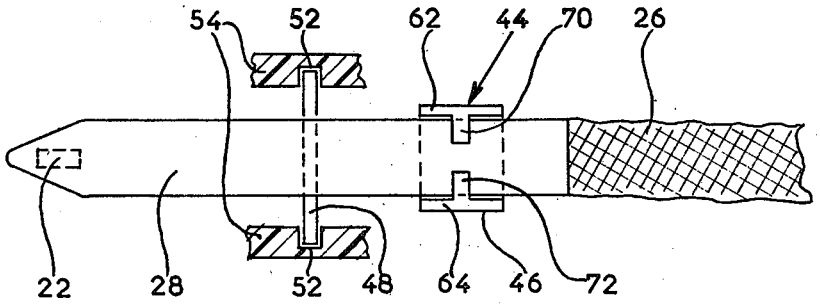
FIG. 4 is a top view of the movable contact arm positioned within the magnetic opening device.

Contact arm 28 is pinned in its middle 50 by a pin 48 to a generally U-shaped bracket 30. Pin 48 is rigidly secured in openings 52 provided in the side flanges 54 of the bracket 30 and allows for a small rotation of contact arm 48 (FIG. 4). The brackets 30 for the three poles are fixedly secured to a common tie bar 32 and the tie bar 32 is mounted for pivotal movement between open and closed positions. The toggle mechanism 17 is pivotally connected to the center pole contact arm bracket 30 to move all of the three contact arms 28 to the open or closed position. The circuit breaker is manually operated by movement of the handle 40 which passes through an opening 42 in cover 16 and actuates the operating toggle mechanism 17. The circuit breaker is automatically tripped by operation of the trip unit 15 including a first trip member 11, for instance a bimetal member causing a thermal tripping operation upon occurrence of a moderate overcurrent condition through the circuit breaker and a second trip member 13, for instance an electromagnetic trip member causing an electromagnetic tripping operation upon occurrence of an overcurrent condition above a predetermined magnitude $S_M$ more severe than the previously mentioned moderate overcurrent condition. Such a molded case circuit breaker is well known.

In accordance with the present invention, a magnetic device 44 includes a generally U-shaped yoke 46 of magnetic material such as iron, the bottom part 56 of this yoke 46 being fixedly secured and positioned by means of pins 58, 60 to the base 14 of the molded case 12. The two side flanges or pole pieces 62, 64 of the yoke 46 form a channel having an open top in the contact opening direction. A length L of the contact arm 28, located between the pin 48 and the shunt 26 extends into the channel of the yoke 46. The length L corresponds to the length of the pole pieces 62, 64. The yoke 46 comprises a pair of parallel legs 66, 68 secured at the free ends of the pole pieces 62, 64 and extending in the contact opening direction. The length l of the legs 66, 68 is shorter than the length L of the pole pieces 62, 64 and the free ends 70, 72 of the legs 66, 68 are bent to form a magnetic bight part having an air gap e. This air gap e is smaller than the air gap E between the pole pieces 62, 64 and may be zero.

Figure 3:
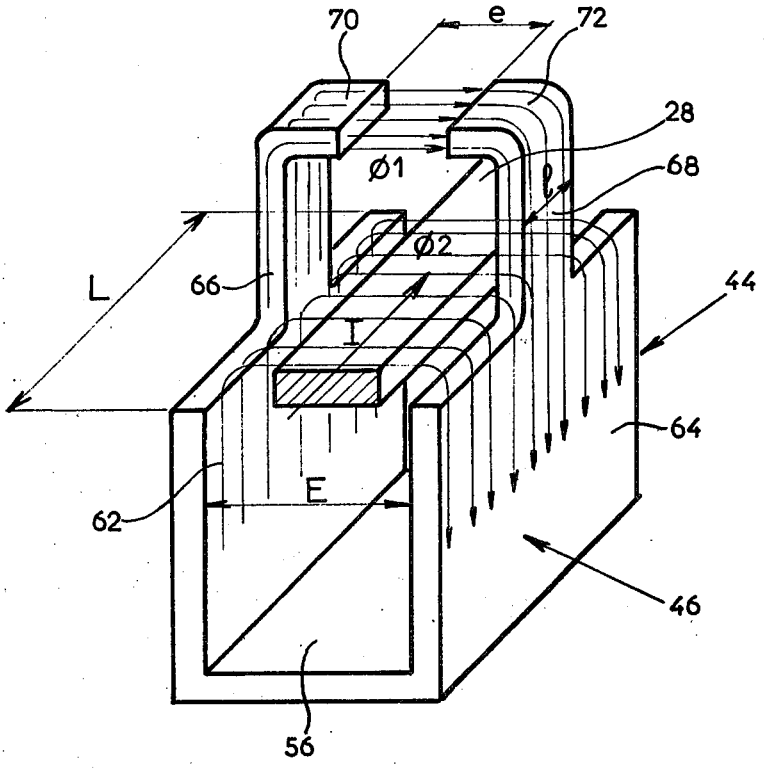
FIG. 3 is a perspective view of the magnetic opening device of the pole of FIG. 1.

When the contacts 18, 22 are closed the contact arm 28 extends in proximity to the free ends of the pole pieces 62, 64 and a current flowing through the contact arm 28 generates a magnetic flux in the yoke 46. As can be seen in FIG. 3, the flux takes two pathes, a flux path $\Phi_2$ which crosses the air gap E and flows in the iron of the bottom of the yoke 46 and another flux path $\Phi_1$ of lower reluctance which crosses the air gap e and flows in the iron of the legs 66, 68 and of the yoke 46. The iron section of the legs 66, 68 is small and this will cause the iron of the flux path $\Phi_1$ to saturate first. The saturation occurs when the current I flowing in the contact arm 28 is higher than a predetermined value corresponding to the electromagnetic trip magnitude $S_M$. After saturation of the flux path $\Phi_1$ the flux flow across the air gap E increases. The contact arm 28 carrying current is located in the magnetic field in the air gap E and the electromagnetic force generated by the interaction between the current flow in the contact arm 28 and the magnetic flux in air gap E acts to move the contact arm 28 towards the bottom of the yoke 46 to separate the contacts 18, 22. A spring 74 positioned between the side flanges 62, 64 urges the contact arm 28 for engagement of the movable contact 22 with the fixed contact 18. The bight part 70, 72 of the yoke 46 limits counterclockwise rotation of the contact arm 28 about the pivot pin 48.

This device operates as follows:

When the circuit breaker is in the closed circuit position shown in FIG. 1, the spring 74 urges the movable contact 22 in engagement and the contact arm 28 extends through the air gap E in the area of the free ends of the pole pieces 62, 64, for instance slightly above these free ends. Upon the occurrence of normal current conditions and moderate overcurrent conditions up to the predetermined magnitude $S_M$, practically all of the flux generated in the yoke 46 flows in the flux path $\Phi_1$ across the air gap e of smaller reluctance than flux path $\Phi_2$. The flux density in the air gap E is very small so that the contact arm 28 remains in the closed position. The magnetic device 44 does not intervene. The moderate overcurrent causes heating of the bimetal member and a thermal tripping operation in a well known manner.

Figure 2:
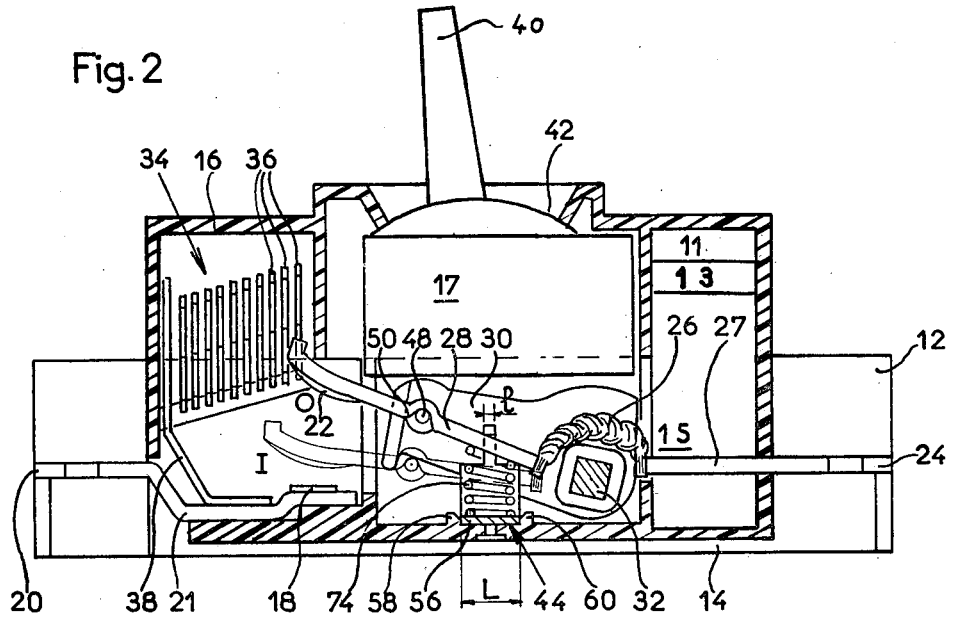
FIG. 2 shows the pole of FIG. 1 respectively in an intermediary position I (fine lines) and in the OF position (thick lines)

Upon the occurrence of a fault current, such as a short circuit current, exceeding the predetermined threshold value $S_M$, the iron of the legs 66, 68 saturates rapidly and the magnetic flux flow is diverted in the flux path $\Phi_2$, across the air gap E. The current-carrying contact arm 28 will have a force acting on it which causes the contact arm 28 to move across the magnetic field towards the bottom of the yoke 46. This electromagnetic force overcomes the force of spring 74 and the contact arm 28 rotates clockwise about the pin 48 causing separation of the movable contact 22 from the fixed contact 18. This force provides a high initial acceleration and brings quickly the contact arm 28 from rest to high velocity. The rapid contact separation creates a current limitation. As the current value exceeds the predetermined magnitude $S_M$ of the electromagnetically operable tripping member 13 the latter is energized at the same time to collapse the toggle mechanism 17 and to move the backets 30 to the open position. The electromagnetic force moves rapidly the movable contact 22 in the intermediary position I shown in FIG. 2 in fine lines and the magnetic tripping initiates the full opening of the circuit breaker (FIG. 2, thick lines).

The magnetic device 44 causes a straigthforward opening of the contacts 18, 22 without erratic movements thereof. Contact arm 28 is advantageously of non magnetic conductive material but may be of ferromagnetic material in which case the air gap E would be modified. The generally U-shaped yoke 46 may cooperate with the front part of contact arm 28 and correspondingly been positioned above this contact arm. The saturable flux flow shunt path may of course be disposed otherwise.

What is claimed is:

1. A circuit breaker comprising:

a pair of separable contacts, a contact arm in electrical conductive material carrying one of the said contacts, the circuit through said circuit breaker in the closed position passing through said contact arm and said contacts, a magnetic device comprising a generally U-shaped magnetic main path having a main air gap, said contact arm extending in said main air gap when in a closed circuit position and a saturable magnetic shunt path, the reluctance of the shunt path being lower than the reluctance of the main path, a current condition through said circuit breaker below a predetermined value generating magnetic flux mainly flowing in said shunt path, a current condition through said circuit breaker above a predetermined value generating magnetic flux saturating said shunt path and flowing mainly in said main path to develop an electromagnetic force acting on said contact arm to separate said contacts.

2. A circuit breaker according to claim 1, wherein said magnetic shunt path has an air gap smaller than said main air gap.

3. A circuit breaker according to claim 1 or 2, comprising a generally U-shaped magnetic yoke having two pole pieces confining said main air gap and two legs extending said pole pieces to form said shunt path, said contact arm being positioned in the closed circuit position in proximity to the end of said pole pieces, the iron section of said legs being smaller than the iron section of said pole pieces to saturate first.

4. A circuit breaker according to claim 3, comprising a spring positioned between said two pole pieces and acting on said contact arm to urge it in the closed circuit position.

5. A circuit breaker according to claim 4, wherein said two legs have bended extremities separated by a shunt air gap and forming an abutment limiting the contact arm movement.

6. A circuit breaker according to claim 1, having a tripping device and an operating toggle mechanism to actuate said contacts in the open position upon occurrence of an overcurrent condition above the said predetermined value generating said electromagnetic force to separate said contacts.

7. A circuit breaker according to claim 1, comprising a support bracket, an operating toggle mechanism to actuate said support bracket between open and closed positions, a contact arm pivotally mounted on said bracket, the part of said contact arm respectively carrying one of said contacts and extending through said magnetic device being on both sides of the contact arm pivot axis.

* * * * *